US008923722B2

(12) United States Patent
Choi et al.

(10) Patent No.: US 8,923,722 B2
(45) Date of Patent: Dec. 30, 2014

(54) SWITCHING MODE POWER SUPPLY OF IMAGE FORMING APPARATUS AND METHOD OF SUPPLYING POWER ACCORDING TO STATE OF IMAGE FORMING APPARATUS BY USING THE SAME

(75) Inventors: Sung-kyu Choi, Suwon-si (KR); Jong-myung Heo, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 913 days.

(21) Appl. No.: 13/080,971

(22) Filed: Apr. 6, 2011

(65) Prior Publication Data

US 2012/0002995 A1 Jan. 5, 2012

(30) Foreign Application Priority Data

Jul. 5, 2010 (KR) ..... 10-2010-0064390

(51) Int. Cl.
*G03G 15/00* (2006.01)

(52) U.S. Cl.
CPC ..... *G03G 15/5004* (2013.01)
USPC ..... 399/88; 399/37

(58) Field of Classification Search
CPC ..... G03G 15/5004
USPC ..... 399/88, 18, 37
See application file for complete search history.

(56) References Cited

U.S. PATENT DOCUMENTS

| | | | | |
|---|---|---|---|---|
| 2008/0199203 | A1 | 8/2008 | Seo | |
| 2009/0185402 | A1 | 7/2009 | Lam et al. | |
| 2011/0176827 | A1 * | 7/2011 | Tobita | 399/88 |
| 2013/0129367 | A1 * | 5/2013 | Jeong et al. | 399/37 |

FOREIGN PATENT DOCUMENTS

CN 201383758 1/2010

OTHER PUBLICATIONS

First Office Action, dated Sep. 2, 2014, in corresponding Chinese Application No. 201110185956X (15 pp.).

* cited by examiner

*Primary Examiner* — Susan Lee
(74) *Attorney, Agent, or Firm* — Staas & Halsey LLP

(57) ABSTRACT

The present general inventive concept describes a switching mode power supply (SMPS) and a method of supplying power by using the same. An SMPS that may be used in an image forming apparatus can include a transformation unit to transform an alternating-current (AC) voltage input to the SMPS, into at least one direct-current (DC) voltage by using a transformer, a first output voltage output unit to output the transformed DC voltage as a first output voltage of the SMPS, a first switching unit to prevent output of the second output voltage, and a second switching unit to prevent output of the second output voltage.

37 Claims, 5 Drawing Sheets

SWITCHING MODE POWER SUPPLY OF IMAGE FORMING APPARATUS AND METHOD OF SUPPLYING POWER ACCORDING TO STATE OF IMAGE FORMING APPARATUS BY USING THE SAME

CROSS-REFERENCE TO RELATED APPLICATIONS

This application claims priority under 35 U.S.C. §119 from Korean Patent Application No. 10-2010-0064390, filed on Jul. 5, 2010, in the Korean Intellectual Property Office, the disclosure of which is incorporated herein in its entirety by reference.

BACKGROUND

1. Field of the General Inventive Concept

The present general inventive concept relates to a switching mode power supply (SMPS) and a method of supplying power by using the same.

2. Description of the Related Art

As a power supply to supply power to an electronic product, a switching mode power supply (SMPS) may be used. An SMPS transforms an input alternating-current (AC) voltage and outputs a constant voltage to operate an electronic product. If an electronic product is in a standby mode for a predetermined period of time, the electronic product enters a power saving mode. Since some functions of the electronic product have to be ensured even in the power saving mode, a power supply operation is not stopped completely. Currently, restraints on standby power of electronic products are getting strong to globally reduce generation of carbon dioxide, and thus a solution to reduce power consumption of a power supply in a power saving mode is required. Also, if an inrush current is generated by a power supply, the security of a system may not be ensured.

SUMMARY

The present general inventive concept provides a switching mode power supply (SMPS) and a method of supplying power by using the same.

The present general inventive concept also provides a computer-readable recording medium having recorded thereon a computer program to execute the method.

Additional aspects will be set forth in part in the description which follows and, in part, will be apparent from the description, or may be learned by practice of the presented embodiments.

Embodiments of the present general inventive concept may be achieved by providing a switching mode power supply (SMPS) for an image forming apparatus, the SMPC including a transformation unit to transform an alternating-current (AC) voltage input to the SMPS, into at least one direct-current (DC) voltage by using a transformer, a first output voltage output unit to output the transformed DC voltage as a first output voltage of the SMPS, and a second output voltage output unit to output the transformed DC voltage as a second output voltage of the SMPS, wherein the second output voltage output unit includes a first switching unit to prevent output of the second output voltage if a cover of the image forming apparatus is open, and a second switching unit to prevent output of the second output voltage if the image forming apparatus is in a power saving mode, and wherein the second switching unit is located closer to a terminal to output the second output voltage in comparison to the first switching unit.

Embodiments of the present general inventive concept may also be achieved by providing an image forming apparatus including a switching mode power supply (SMPS) to output a first output voltage and a second output voltage, the image forming apparatus including the SMPS to turn off a first switching unit to prevent output of the second output voltage if a cover of the image forming apparatus is open, receiving from the image forming apparatus a control signal to control a second switching unit of the SMPS, and turning off the second switching unit according to the received control signal, a main system to be operable by the first output voltage if the cover of the image forming apparatus is open, and to output a control signal to control the second switching unit, and an image forming unit to be operable by the second output voltage, and to form an image of print data, wherein the second switching unit of the SMPS is located closer to a terminal to output the second output voltage in comparison to the first switching unit.

Embodiments of the present general inventive concept may also be achieved by providing a method of supplying power to an image forming apparatus by using a switching mode power supply (SMPS) to output a first output voltage and a second output voltage, the method including turning off a first switching unit to prevent output of the second output voltage if a cover of the image forming apparatus is open, receiving from the image forming apparatus a control signal to control a second switching unit of the SMPS, if the image forming apparatus is in a power saving mode, and turning off the second switching unit according to the received control signal, wherein the second switching unit is located closer to a terminal to output the second output voltage in comparison to the first switching unit.

Embodiments of the present general inventive concept may also be achieved by providing a computer-readable recording medium having recorded thereon a computer program to execute the method.

Embodiments of the present general inventive concept may also be achieved by providing a switching mode power supply (SMPS) apparatus of an image forming apparatus including a transformation unit to transform an AC voltage into at least one DC voltage input to the SMPS, and a voltage output unit to output the transformed DC voltage as an output voltage of the SMPS, the voltage output unit including a first switching unit to turn off and send a notification signal to the image forming apparatus when a cover of the image forming apparatus is opened, a second switching unit to turn off upon receiving a control signal from the image forming apparatus after the turning off of the first switching unit, and a delay unit connected between the first switching unit and the second switching unit to discharge electric charges after the turning off of the first switching unit to prevent abrupt turn on of the second switching unit.

The first switching unit may receive an output voltage from the transformation unit.

The second switching unit is connected to the first switching unit and may be turned on after the first switching unit is turned on.

The SMPS apparatus may further include a first terminal to output the transformed DC voltage to the image forming apparatus, and a second terminal to receive a signal from the image forming apparatus to indicate that the image forming apparatus is in a power saving mode after the first switching unit is turned off.

The second switching unit may include a first transistor turned on or off by the control signal output from the image forming apparatus.

The second switching unit may further include a second transistor to be turned on or off according to the on or off operation of the first transistor.

The second switching unit may further include a second transistor to be turned on or off according to a voltage applied to the second transistor by the first switching unit.

The second switching unit may further include a second transistor to be turned off when a difference between a source voltage and a gate voltage of the second transistor is less than a predetermined threshold voltage.

The second switching unit may further include a second transistor, wherein the image forming apparatus uses a second control signal to turn off the first transistor to prevent the second transistor from being turned on when the first switching unit is turned on.

Embodiments of the present general inventive concept may also be achieved by operating a switching mode power supply (SMPS) of an image forming apparatus, including turning off a first switching unit of the power supply after detecting a cover of the image forming apparatus being opened, receiving a signal from the image forming apparatus to operate the SMPS in a power saving mode after turning off the first switching unit, and discharging electric charges through a delay unit of the SMPS to prevent abrupt turn on of a second switching unit of the SMPS.

The method may further include the first switching unit being turned on after detecting a closing of the cover, and charging the delay unit to delay a turn-on time of the second switching unit after the turning on of the first switching unit.

The method may further include turning on the first switching unit before the discharging of the delay unit is complete, notifying the image forming apparatus that the delay unit is not totally discharged, and receiving a control signal from the image forming apparatus to prevent turn on of the second switching unit before total discharge of the delay unit.

The control signal may turn off a first transistor of the second switching unit to prevent the turn on of a second transistor of the second switching unit.

The delay unit of the SMPS may be discharged for a first period of time and the image forming apparatus delays the control signal to control a transistor of the second switching unit by a second period of time greater than the first period of time.

Embodiments of the present general inventive concept may also be achieved by operating a switching mode power supply (SMPS) of an image forming apparatus, the method including turning off a first switching unit upon opening of a cover of an image forming apparatus, receiving a control signal from the image forming apparatus that the image forming apparatus is in a power save mode after the first switching unit is turned off, turning on the first switching unit upon closing the cover to put the image forming apparatus in a ready mode, and delaying a turn-on time of a second switching unit in the ready mode to prevent the SMPS from being abruptly turned on.

Embodiments of the present general inventive concept may also be achieved by operating a switching mode power supply (SMPS) of an image forming apparatus, including turning off a first switching unit in the SMPS to prevent DC voltage being applied to a second switching unit, discharging electric charges in a delay unit of the SMPS upon turning off the first switching unit, and turning off the second switching unit after discharging the electric charges charged in the delay unit to reduce power consumption of the SMPS.

The second switching unit may be turned off by receiving a control signal from the image forming apparatus when the cover of the image forming apparatus is closed.

BRIEF DESCRIPTION OF THE DRAWINGS

The above and other features and utilities of the present general inventive concept will become more apparent more readily appreciated from the following description of the exemplary embodiments, taken in conjunction with the accompanying drawings in which.

DETAILED DESCRIPTION OF THE PREFERRED EMBODIMENTS

Figure 1:
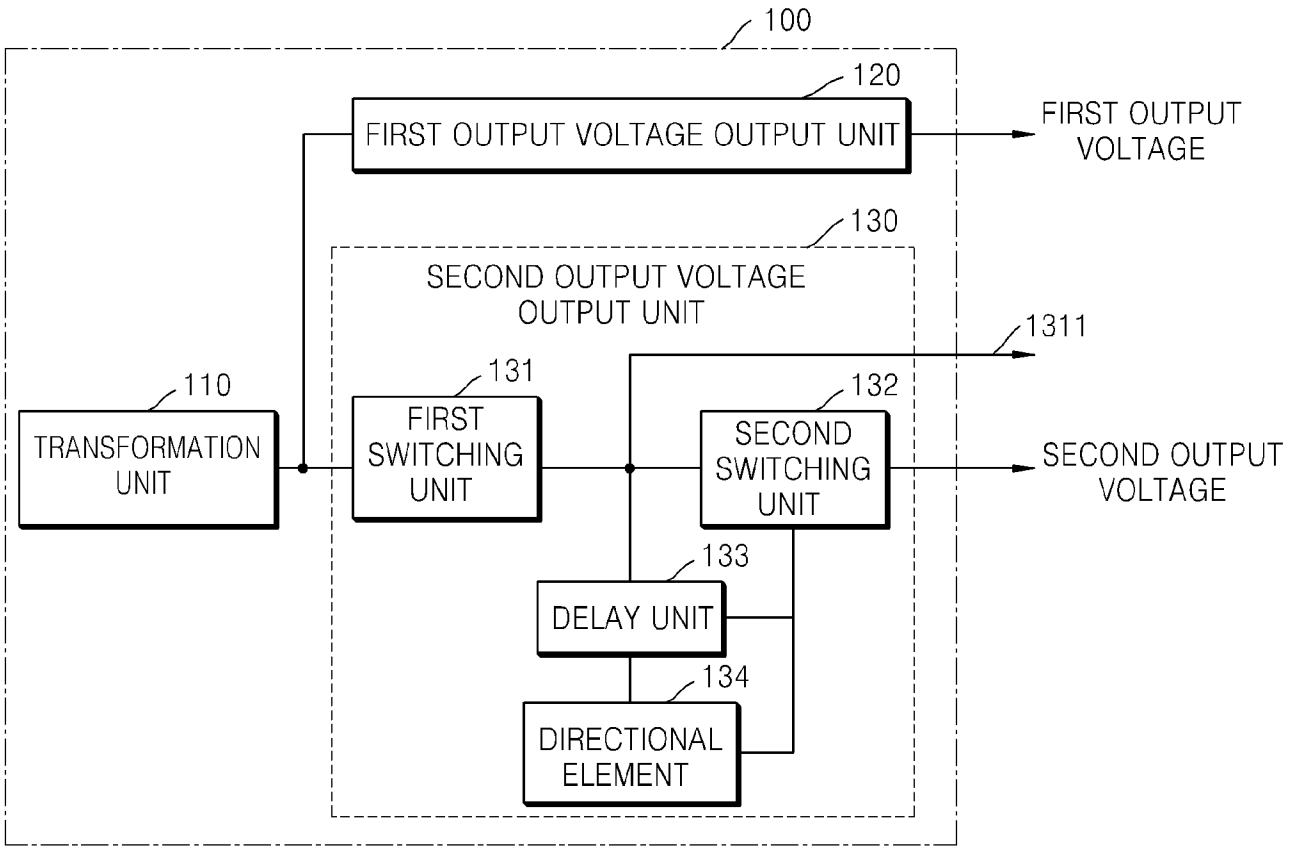
FIG. 1 is a block diagram illustrating a switching mode power supply (SMPS) according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a block diagram illustrating a switching mode power supply (SMPS) 100 according to an embodiment of the present general inventive concept. Referring to FIG. 1, the SMPS 100 may include a transformation unit 110, a first output voltage output unit 120, and a second output voltage output unit 130. The second output voltage output unit 130 may include a first switching unit 131, a second switching unit 132, a delay unit 133, and a directional element 134.

It will be understood by one of ordinary skill in the art that the SMPS 100 may further include general-use components in addition to the components illustrated in FIG. 1.

The SMPS 100 illustrated in FIG. 1 may be, but is not limited to, an SMPS for an image forming apparatus. Hereinafter, it is assumed for convenience of explanation that the SMPS 100 is used in an image forming apparatus. However, the present general inventive concept is not limited thereto and it will be understood by one of ordinary skill in the art that the SMPS 100 may be used to supply power to many other electronic devices such as an image reading device, a multifunction peripheral (MFP), a personal computer (PC), a fax, a television (TV), a DVD player, electronic household appliances, etc.

The transformation unit 110 transforms an alternating-current (AC) voltage input to the SMPS 100, into at least one direct-current (DC) voltage by using a transformer. That is, the transformation unit 110 rectifies an AC voltage and the rectified voltage may be switched, passed through the transformer, and transformed into at least one DC voltage.

In more detail, the transformation unit 110 may include a rectification element (not illustrated) to rectify the AC voltage, and a smoothing element (not illustrated) to smooth the rectified voltage. For example, the rectification element may be, but is not limited to, a bridge circuit using a diode and the smoothing element may be, but is not limited to, a capacitor.

Also, the transformation unit 110 may further include a switching control unit 111 (FIG. 3) to control operation of switching to apply the rectified voltage to the transformer. The switching control unit may be, but is not limited to, a pulse-width modulation (PWM) integrated circuit (IC).

Furthermore, the transformation unit 110 may further include a transformer (illustrated in FIG. 3) to transform the switched voltage into an output voltage of the SMPS 100. In this case, the transformer transfers electrical energy from one circuit to another circuit by using an induction operation of coil. The transformation unit 110 may transform the switched voltage into a first output voltage and a second output voltage of the SMPS 100 by using the transformer.

The first output voltage output unit 120 outputs a DC voltage transformed by the transformation unit 110 as a first output voltage of the SMPS 100. In this case, the first output voltage may be used to operate a main system including a microcomputer of the image forming apparatus and may be, but is not limited to, a DC voltage of about 5 volts or about 3.3 volts.

The second output voltage output unit 130 may output a DC voltage transformed by the transformation unit 110 as the second output voltage of the SMPS 100. In this case, the second output voltage may be used to operate an image forming unit of the image forming apparatus and may be a DC voltage of about 24 volts. The image forming unit may include hardware components to perform electrifying, exposing, developing, transferring, and fixing operations to form an image of print data.

Referring to FIG. 1, the second output voltage output unit 130 may include a first switching unit 131, a second switching unit 132, a delay unit 133, and a directional element 134.

The first switching unit 131 can prevent the DC voltage transformed by the transformation unit 110 from being output from the SMPS 100 as the second output voltage in such a circumstance as a cover of the image forming apparatus being open, ajar, or malfunctioning. The first switching unit 131 prevents output of the second output voltage from the SMPS 100 in hardware.

For example, the first switching unit 131 may be an electro-mechanical switch to be turned on or off according to whether a cover of the image forming apparatus is open or closed. The electro-mechanical switch may be, but is not limited to, a microswitch or a relay. A cover of the image forming apparatus may refer to a member mounted on a main body of the image forming apparatus and being openable to view the inside of the main body.

The first switching unit 131 may also prevent a DC voltage from being output from the SMPS 100 when other external elements are open, ajar, or functioning incorrectly. External elements can include doors to access toner cartridges, rollers, and other mechanical parts, feeding trays for print medium, or covers for user access panels. Therefore, the use of the term cover in this description may refer to a number of external elements, of an image forming apparatus or other electronic device, whose open or malfunctioning status will preclude operation of the electronic device.

If a cover of an image forming apparatus is open, the first switching unit 131 is switched to an open position and turned off. As such, output of the second output voltage from the SMPS 100 can be prevented. Since the second output voltage is not output from the SMPS 100 if the cover of the image forming apparatus is open, power is not supplied to a motor, a developing unit, a high voltage power supply (HVPS), etc. of the image forming apparatus.

Accordingly, since a high-pressure voltage is applied in an image forming apparatus during the functioning thereof, once the cover of the image forming apparatus is open and the SMPS does not output the second output voltage, safety of users may be ensured and power consumption of the image forming apparatus may be reduced.

If the image forming apparatus is in a power saving mode, the second switching unit 132 prevents the DC voltage transformed by the transformation unit 110 from being output from the SMPS 100 as the second output voltage. The second switching unit 132 may prevent output of the second output voltage from the SMPS 100 in software by using a signal output from the image forming apparatus and representing whether the image forming apparatus is in the power saving mode.

For example, the second switching unit 132 may receive from a control unit or controller of the image forming apparatus a signal representing that the image forming apparatus is in the power saving mode. The second switching unit 132 may thus prevent the DC voltage transformed by the transformation unit 110 from being output from the SMPS 100 as the second output voltage by using the received signal. In this case, the second switching unit 132 may include, but is not limited to, a transistor or a metal-oxide-semiconductor field-effect transistor (MOSFET) to prevent output of the second output voltage.

If the image forming apparatus is in a power saving mode, the second switching unit 132 is turned off by using the signal output from the image forming apparatus and representing that the image forming apparatus is in the power saving mode. As such, output of the second output voltage from the SMPS 100 may be prevented.

Accordingly, since output of the second output voltage from the SMPS 100 is prevented if the image forming apparatus is in the power saving mode, standby power of the image forming apparatus may be reduced. When the second switching unit 132 is turned off, the second switching unit 132 may also be said to be in power saving mode.

However, even if the second output voltage is not output from the SMPS 100, the main system of the image forming apparatus may be ensured to operate by the first output voltage output from the first output voltage output unit 120.

The second switching unit 132 may be located closer to a terminal to output the second output voltage in comparison to the location of the first switching unit 131 in the SMPS 100. For example, in a current flowing direction, the second switching unit 132 to be turned on or off according to whether the image forming apparatus is in the power saving mode is located subsequent to the first switching unit 131 to be turned on or off according to whether the cover of the image forming apparatus is open or closed. That is, the first switching unit 131 is located at a side of the transformation unit 110 that outputs the DC voltage, and the second switching unit 132 is located at a side of the terminal to output the second output voltage from the SMPS 100. In this case, the side of the terminal to output the second output voltage may be a side of a load of the image forming apparatus or other electronic device.

As such, if the image forming apparatus is in the power saving mode, the SMPS 100 may output to the main system a signal 1311 (FIG. 2) representing whether a cover or other external element of the image forming apparatus is open or closed. Accordingly, even if the image forming apparatus is in the power saving mode, the main system of the image forming apparatus may recognize whether the cover of the image forming apparatus is open or closed.

For example, the second switching unit 132 is turned off if the image forming apparatus is in the power saving mode. Since the first switching unit 131 is an electro-mechanical switch, the first switching unit 131 may operate regardless of the on or off operation of the second switching unit 132. If the second switching unit 132 is turned off and the cover of the image forming apparatus is open, the first switching unit 131 is turned off. In this case, the main system of the image forming apparatus may receive the signal 1311 representing whether the cover of the image forming apparatus is open or closed from a node between the first switching unit 131 and the second switching unit 132 and thus may recognize whether the cover of the image forming apparatus is open or closed.

If the first switching unit 131 is alternatively located at the side of the terminal to output the second output voltage from the SMPS 100 and the second switching unit 132 is located at the side of the transformation unit 110 to output the DC voltage, the SMPS 100 may not recognize whether the cover of the image forming apparatus is open or closed in the power saving mode.

Accordingly, since the second switching unit 132 is located closer to the terminal to output the second output voltage in comparison to the first switching unit 131, even if the image forming apparatus is in the power saving mode, the main system of the image forming apparatus may recognize whether the cover of the image forming apparatus is open or closed via the signal 1311. As such, if the cover or other external element of the image forming apparatus or electronic device is open in the power saving mode and then is closed, the image forming apparatus may be efficiently switched to a ready mode. The ready mode may refer to, but is not limited to, a mode in which the image forming apparatus may perform operations according to functions of the image forming apparatus.

The delay unit 133 delays a turn-on time of the second switching unit 132 that is turned off in the power save mode. The delay unit 133 may include, but is not limited to, a capacitor to charge electric charges.

For example, if the cover becomes closed, the first switching unit 131 is turned on, and a voltage applied to the second switching unit 132 smoothly changes due to the electric charges charged in the delay unit 133. As such, the SMPS 100 may prevent the second switching unit 132 from being abruptly turned on.

If the cover of the image forming apparatus is open, the directional element 134 may discharge electric charges charged in the delay unit 133. For example, the directional element 134 may be a diode to pass electric charges only in one direction, but is not limited thereto, and may also be a thyristor or a triode AC switch (TRIAC) to pass electric charges only in one direction. In this case, the thyristor or the TRIAC may be used as the directional element 134 by inputting an on signal to a gate terminal.

Also, it will be understood by one of ordinary skill in the art that, as an example of the directional element 134, the diode may include a Schottky diode, a light emitting diode (LED), a Zener diode, a transient voltage suppression (TVS) diode, etc.

If the cover of the image forming apparatus is open, the first switching unit 131 is turned off. As such, the DC voltage transformed by the transformation unit 110 is not applied to the second switching unit 132 and thus the second switching unit 132 is also turned off. In this case, the second switching unit 132 is turned off after a period of time to discharge the electric charges charged in the delay unit 133 after the first switching unit 131 is turned off.

However, if the cover of the image forming apparatus is closed, the main system of the image forming apparatus may output a control signal via terminal 1302 (FIG. 2) to control the second switching unit 132 and it will be understood by one of ordinary skill in the art that the second switching unit 132 may be turned on or off according to the control signal.

If the first switching unit 131 is on when the electric charges charged by the delay unit 133 are not completely discharged, that is, if the cover of the image forming apparatus is closed when the electric charges charged by the delay unit 133 are not completely discharged, the second switching unit 132 may be abruptly turned on and thus an inrush current may be output from the SMPS 100. In this case, the inrush current refers to a current that abnormally excessively flows at a transitional moment or at a moment when a switch is turned on.

That is, after both the first switching unit 131 and the second switching unit 132 are turned off, if the first switching unit 131 is turned on within a predetermined period of time, the inrush current may be output from the SMPS 100. In this case, the predetermined period of time may refer to, but is not limited to, a period of time taken to completely discharge the electric charges charged by the delay unit 133.

If the inrush current is output from the SMPS 100, the first output voltage output from the first output voltage output unit 120 may be dropped, and then the image forming apparatus may be reset.

In the SMPS 100, if the first switching unit 131 is turned off, the electric charges charged by the delay unit 133 may be discharged by the directional element 134 within a short period of time.

As such, even if the cover of the image forming apparatus is open and then is closed within a short period of time, output of the inrush current from the SMPS 100 may be prevented. That is, since the directional element 134 discharges the electric charges charged by the delay unit 133 within a short period of time, generation of the inrush current by the SMPS 100 may be prevented and thus malfunctions of the SMPS 100 and the image forming apparatus may also be prevented.

Figure 2:
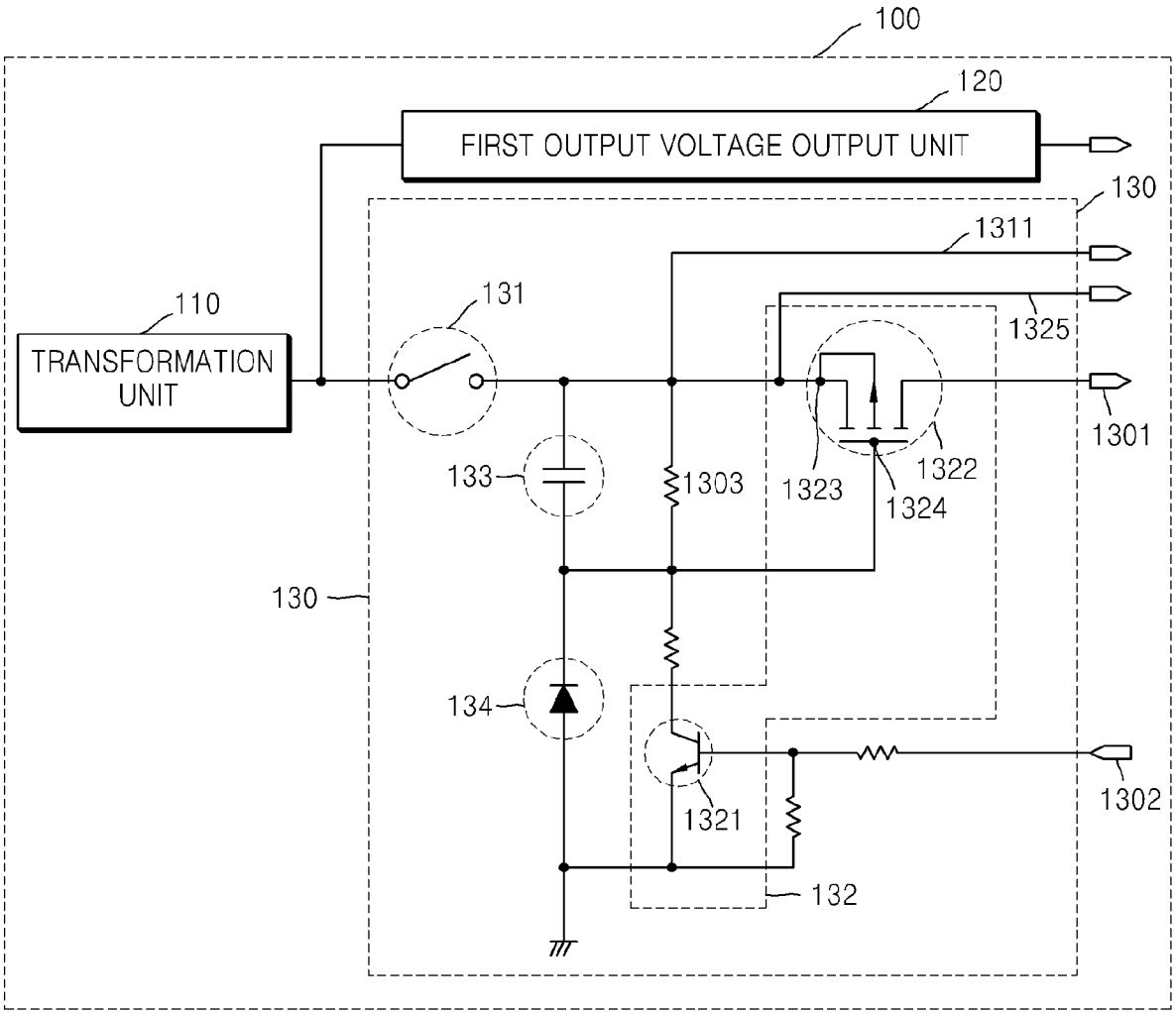
FIG. 2 is a circuit diagram illustrating a second output voltage output unit illustrated in FIG. 1, according to an embodiment of the present general inventive concept.

FIG. 2 is a circuit diagram illustrating the second output voltage output unit 130 illustrated in FIG. 1, according to an embodiment of the present general inventive concept. Referring to FIG. 2, the second output voltage output unit 130 may include the first switching unit 131, the second switching unit 132, the delay unit 133, and the directional element 134. The second switching unit 132 may include a transistor 1321 and a MOSFET 1322. Also, the second output voltage output unit 130 may further include a terminal 1301 to output the second output voltage, a terminal 1302 to receive a signal representing whether the image forming apparatus is in the power saving mode, and a resistor 1303.

It will be understood by one of ordinary skill in the art that the second output voltage output unit 130 may further include general-use components in addition to the components illustrated in FIG. 2.

Referring to FIG. 2, the second switching unit 132 is located closer to the terminal 1301 to output the second output voltage in comparison to the location of the first switching unit 131, which is closer to the transformation unit 110. Thus, if the image forming apparatus is in the power saving mode the SMPS 100 may output the signal 1311 representing whether the cover of the image forming apparatus is open or closed. Accordingly, even in the power saving mode, the image forming apparatus may recognize whether the cover of the image forming apparatus is open or closed.

That is, even if the image forming apparatus is in the power saving mode and thus the second switching unit 132 is turned off, the main system of the image forming apparatus may recognize whether the cover of the image forming apparatus is open or closed, by using the signal 1311 representing whether the cover of the image forming apparatus is open or closed. Accordingly, the SMPS 100 may improve the operational efficiency of the image forming apparatus by allowing the image forming apparatus to recognize whether the cover of the image forming apparatus is open or closed even in the power saving mode.

The first switching unit 131 is turned off if the cover of the image forming apparatus is open. For example, if the cover of the image forming apparatus is open, a contact point of an electro-mechanical switch that is an example of the first switching unit 131 is separated and thus the first switching unit 131 may prevent output of the second output voltage from the SMPS 100.

The second switching unit 132 may be turned on or off according to a voltage applied from the first switching unit 131, or a control signal output from the image forming apparatus. In this case, the control signal may be a signal representing that the image forming apparatus in the power saving mode.

Referring to FIG. 2, the second switching unit 132 may include the transistor 1321 and the MOSFET 1322. The transistor 1321 is turned on or off by using a control signal output from the image forming apparatus via terminal 1302, and the MOSFET 1322 may be turned on or off according to the on or off operation of the transistor 1321. Alternatively, the MOSFET 1322 may be turned on or off according to a voltage applied to the MOSFET 1322 by the first switching unit 131.

In an exemplary case when the image forming apparatus is in the power saving mode, the terminal 1302 to receive the signal from the controller representing whether the image forming apparatus is in the power saving mode, receives from the image forming apparatus a signal representing that the image forming apparatus is in the power saving mode (e.g., a low signal). If the signal representing that the image forming apparatus is in the power saving mode is received by the terminal 1302, the transistor 1321 is turned off and thus the MOSFET 1322 is turned off.

Also, in an exemplary case when the cover of the image forming apparatus is open, if the cover of the image forming apparatus is open, the image forming apparatus may output a control signal to turn off the transistor 1321 (e.g., a low signal), the transistor 1321 may be turned off by receiving the control signal, and thus the MOSFET 1322 may be turned off.

Furthermore, in another exemplary case when the cover of the image forming apparatus is open, if the cover of the image forming apparatus is open, the first switching unit 131 is turned off. As such, the MOSFET 1322 is turned off after a period of time to discharge the electric charges charged by the delay unit 133, or after a difference between a voltage of a source 1323 and a voltage of a gate 1324 of the MOSFET 1322 is equal to or less than a predetermined threshold voltage. In this case, the transistor 1321 may be continuously turned on. Alternatively, according to a setup environment, the main system of the image forming apparatus may output the control signal to turn off the transistor 1321, in order to prevent the MOSFET 1322 from being abruptly turned on when the first switching unit 131 is turned on.

Accordingly, the second switching unit 132 may prevent output of the second output voltage from the SMPS 100.

Also, if the cover of the image forming apparatus is closed, the main system of the image forming apparatus may output a control signal to turn on the transistor 1321. As such, the MOSFET 1322 is turned on and the second output voltage may be output from the SMPS 100. Furthermore, in this case, the main system of the image forming apparatus may switch a mode of the image forming apparatus to a ready mode.

Also, if both the first switching unit 131 and the second switching unit 132 of the SMPS 100 are turned on, the delay unit 133 charges electric charges. In this case, if the first switching unit 131 is turned off, the electric charges charged by the delay unit 133 may be discharged by the resistor 1303 and the directional element 134.

For example, if the first switching unit 131 is turned off, the gate voltage 1324 of the MOSFET 1322 of the second switching unit 132 is abruptly dropped due to an AC coupling phenomenon of the delay unit 133. As such, if the first switching unit 131 is turned off, the gate voltage 1324 of the MOSFET 1322 may be maintained to be lower than a reference ground voltage. As such, since the voltage potential at a ground node 135 would be greater than a potential at a node 136, the diode direction element 134 would turn on and the electric charges charged by the delay unit 133 may be rapidly discharged by the directional element 134.

In more detail, if the cover of the image forming apparatus is open and then is abruptly closed, the first switching unit 131 is also abruptly turned off and then is abruptly turned on. That is, if the first switching unit 131 is turned on, the DC voltage transformed by the transformation unit 110 is applied to a terminal of the source voltage 1323 of the MOSFET 1322. In this case, the DC voltage transformed by the transformation unit 110 may be the second output voltage.

According to the above turn-on operation of the first switching unit 131, 24 volts received from the transformation unit 110 may be applied to the source terminal 1323 of the MOSFET 1322. Since the gate voltage 1324 is maintained to be lower than the reference ground voltage, a current may be supplied to the gate terminal 1324 from the ground node 135 via an anode side to a cathode side of the directional element 134.

Accordingly, the level of the gate voltage at node 1324 of the MOSFET 1322 is dropped by a forward voltage drop of the directional element 134 (e.g., −0.7 volt) and then is rapidly recovered to the ground level. As such, the electric charges charged by the delay unit 133 may be discharged by the directional element 134 within a short period of time and thus output of an inrush current from the SMPS 100 may be prevented.

Since output of the inrush current from the SMPS 100 is prevented, the image forming apparatus may be prevented from being reset and a voltage of a main controller board of the image forming apparatus may be prevented from being unstable. Accordingly, the image forming apparatus may operate stably.

Also, the second switching unit 132 may output a signal 1325 representing whether the cover of the image forming apparatus is open or closed. In more detail, the signal 1325 representing whether the cover of the image forming apparatus is open or closed may be output from a terminal of the source voltage 1323 of the MOSFET 1322 of the second switching unit 132, upon receiving current through switch 131 from the transformation unit 110.

As such, if the cover of the image forming apparatus is open and then is closed within a first period of time, the second switching unit 132 may be turned on after a second period of time after the cover of the image forming apparatus is closed, by using a control signal output from the image forming apparatus.

For example, if the cover of the image forming apparatus is open and then is closed within the first period of time, the MOSFET 1322 may be turned on after the second period of time after the cover of the image forming apparatus is closed. In this case, the first period of time may be, but is not limited to, less than a period of time to completely discharge the electric charges charged by the delay unit 133. Also, a sum of the first period of time and the second period of time may be, but is not limited to, a period of time equal to or greater than the period of time to completely discharge the electric charges charged by the delay unit 133.

That is, the main system of the image forming apparatus recognizes whether the cover of the image forming apparatus is open or closed, by referring to a signal output from the terminal 1325 from the source node 1323 of the MOSFET 1322. As such, if the cover of the image forming apparatus is open and then is closed during the first period of time, the main system of the image forming apparatus may delay a control signal to control the transistor 1321 by the second period of time.

That is, if the cover of the image forming apparatus is open and then is closed before the electric charges charged by the delay unit 133 are completed discharged, the inrush current may be generated by the SMPS 100. Accordingly, in order to prevent generation of the inrush current, the image forming apparatus allows the second switching unit 132 to be turned on after the electric charges charged by the delay unit 133 are completely discharged. As such, generation of the inrush current by the SMPS 100 may be prevented.

Figure 3:
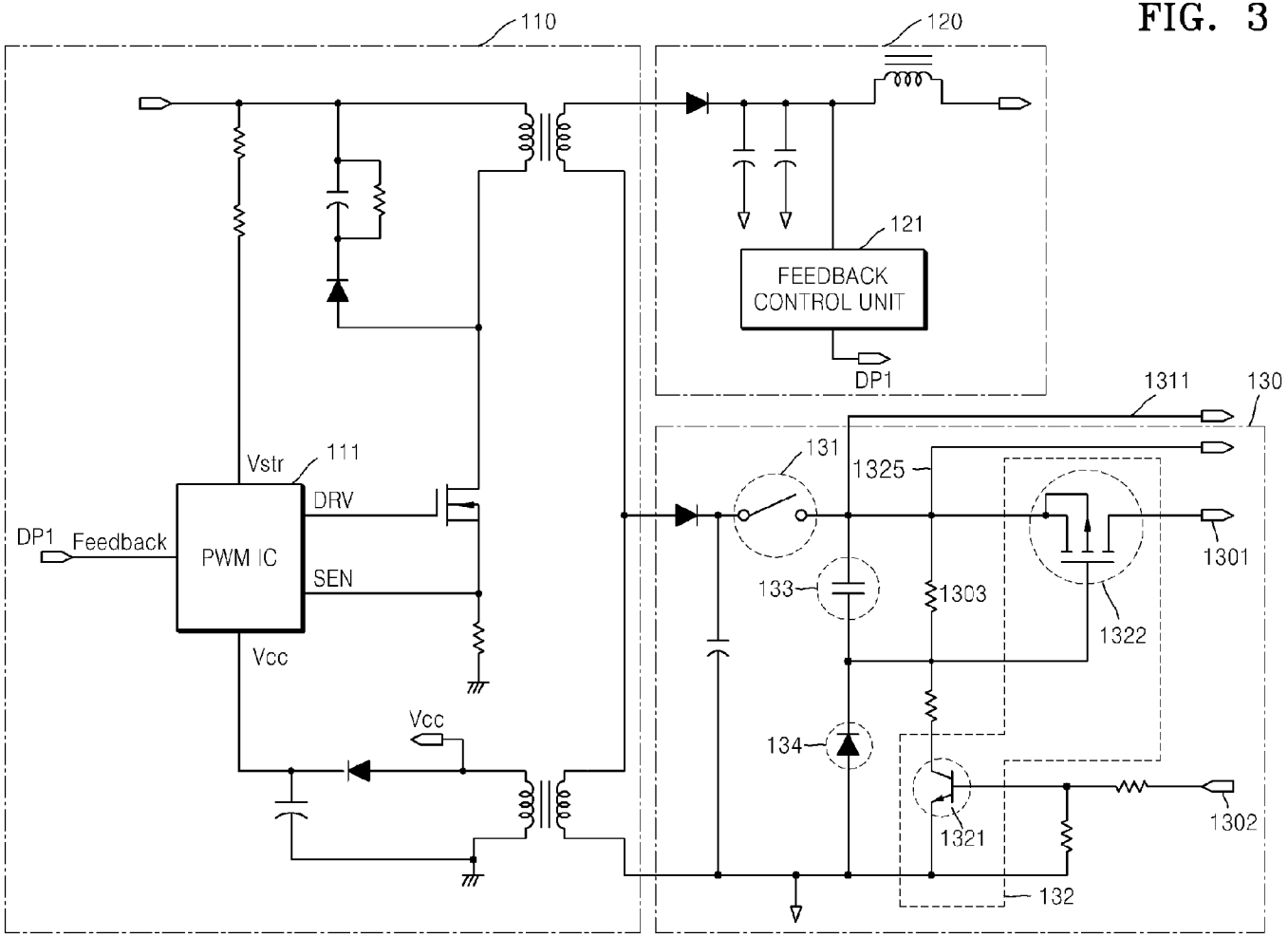
FIG. 3 is a circuit diagram illustrating the SMPS illustrated in FIG. 1, according to an embodiment of the present general inventive concept.

FIG. 3 is a circuit diagram illustrating the SMPS 100 illustrated in FIG. 1, according to an embodiment of the present general inventive concept. It will be understood by one of ordinary skill in the art that the SMPS 100 may further include general-use components in addition to the components illustrated in FIG. 3.

Also, the operational principal of the circuit illustrated in FIG. 3 will be understood by one of ordinary skill in the art based on the descriptions provided above in relation to FIGS. 1 and 2 and thus will not be described in detail here.

Referring to FIG. 3, the SMPS 100 uses one transformer to realize at least two outputs. If one transformer is used, the size and manufacturing cost of the SMPS 100 may be reduced while an inrush current is generated by the SMPS 100 to cause a malfunction of the image forming apparatus.

Also, the first output voltage output unit 120 may control a pulse-width modulation (PWM) IC 111 of the transformation unit 110 by using a feedback control unit 121. For example, since the first output voltage output unit 120 normally operates even in the power saving mode, a switching operation of the PWM IC 111 of the transformation unit 110 in the power saving mode is controlled by the feedback control unit 121.

As described above, if the inrush current is generated by the SMPS 100, the feedback control unit 121 has to increase the duty ratio of the PWM IC 111. That is, the feedback control unit 121 controls the switching operation of the PWM IC 111 to increase the duty ratio of the PWM IC 111 to increase a period of time when a wavelength output from the PWM IC 111 is in an on state.

However, if the inrush current is generated, before the feedback control unit 121 performs the control operation, the first output voltage may be dropped, and then the image forming apparatus is reset.

As such, since the directional element 134 prevents generation of the inrush current by the SMPS 100, the image forming apparatus may be prevented from being reset.

Figure 4:
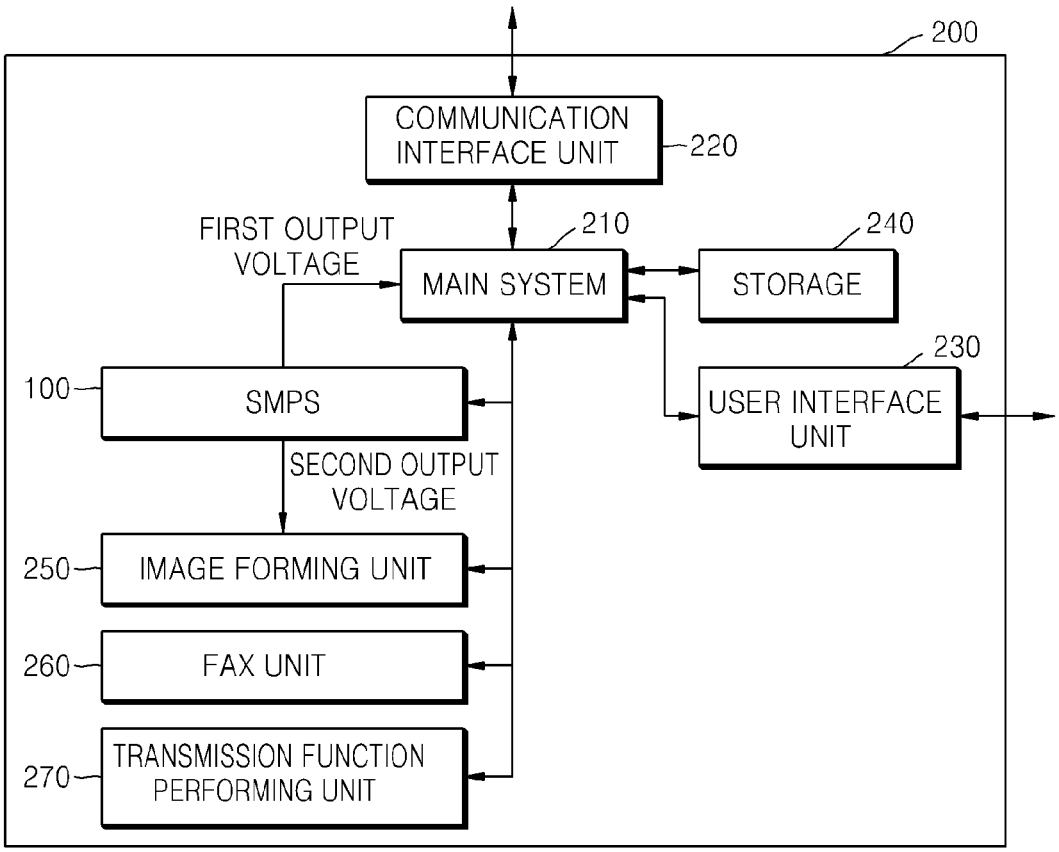
FIG. 4 is a block diagram illustrating an image forming apparatus according to an embodiment of the present general inventive concept.

FIG. 4 is a block diagram illustrating an image forming apparatus 200 according to an embodiment of the present general inventive concept. Referring to FIG. 4, the image forming apparatus 200 includes an SMPS 100, a main system 210, a communication interface unit 220, a user interface unit 230, a storage 240, an image forming unit 250, a fax unit 260, and a transmission function performing unit 270.

It will be understood by one of ordinary skill in the art that the image forming apparatus 200 may further include general-use components in addition to the components illustrated in FIG. 4.

The SMPS 100 illustrated in FIG. 4 and the SMPS 100 illustrated in FIGS. 1 through 3 perform the same operations and thus the descriptions provided above in relation to FIGS. 1 through 3 may also be applied to the SMPS 100 illustrated in FIG. 4.

As illustrated in FIGS. 2 and 4, the SMPS 100 may output a first output voltage and a second output voltage. That is, the SMPS 100 may turn off a first switching unit 131 to prevent output of the second output voltage, if a cover of the image forming apparatus 200 is open. Also, the SMPS 100 may receive a control signal from the main system 210 of the image forming apparatus 200 to control a second switching unit 132 of the SMPS 100, and turn off the second switching unit 132 by using the control signal. In this case, if the cover of the image forming apparatus 200 is open, the SMPS 100 may discharge a delay element by using a directional element to delay a turn-on time of the second switching unit 132.

The main system 210 is operable by the first output voltage if the cover of the image forming apparatus 200 is open, and outputs a control signal to control the second switching unit.

Also, if the image forming apparatus 200 is in a power saving mode, the SMPS 100 outputs a signal representing whether the cover of the image forming apparatus 200 is open or closed, and the main system 210 refers to the signal output from the SMPS 100 and may switch a mode of the image forming apparatus 200 to a ready mode when the cover is closed.

Accordingly, even if the image forming apparatus 200 is in the power saving mode, by referring to whether the cover of the image forming apparatus 200 is open or closed, if the cover of the image forming apparatus 200 is closed, a mode of the image forming apparatus 200 may be switched to the ready mode and thus the operation efficiency of the image forming apparatus 200 may be improved.

Also, if the cover of the image forming apparatus 200 is open and then is closed within a first period of time, the main system 210 outputs a control signal to turn on the second switching unit of the SMPS 100 after a second period of time after the cover of the image forming apparatus 200 is closed by referring to the signal output from the SMPS 100. In this case, the first period of time may be less than a period of time to completely discharge the electric charges charged to delay the turn-on time of the second switching unit, or a sum of the first period of time and the second period of time may be a period of time equal to or greater than the period of time to completely discharge the electric charges charged to delay the turn-on time of the second switching unit.

Accordingly, if the image forming apparatus 200 is in the power saving mode, the SMPS 100 does not output the second output voltage and thus standby power of the image forming apparatus 200 may be reduced. Also, even if the cover of the image forming apparatus 200 is open and then is abruptly closed, stable operation and smooth turn on of the image forming apparatus 200 may be ensured by using the directional element included in the SMPS 100 to charge the delay element.

The main system 210 may include a controller to control overall operations of the image forming apparatus 200.

The communication interface unit 220 may transmit and receive data to and from an external device. Also, the communication interface unit 220 may include a modulator-demodulator (modem) to, for example, transmit and receive faxes, a network module to access a network, a universal serial bus (USB) host module to form a data exchange channel with a mobile storage medium, etc. according to the function of the image forming apparatus 200. In this case, an external device may be a device connected to the image forming apparatus 200 in a wired or wireless network and includes a fax machine, a computer system, a personal digital assistant (PDA), etc.

The user interface unit 230 may receive an input signal from a user and display information to the user. For example, the user interface unit 230 may include input/output (I/O) devices, e.g., a display panel, a mouse, a keyboard, a touch screen, a monitor, and a speaker, included in the image forming apparatus 200.

The storage 240 stores operational data, print data, and scan data of the image forming apparatus 200.

The image forming unit 250 may operate by the second output voltage output from the SMPS 100 and form an image of target print data. The fax unit 260 may transmit fax of target fax data. The transmission function performing unit 270 may transmit target documents to the external device such as a server, a mobile storage medium, or a computer system.

Figure 5:
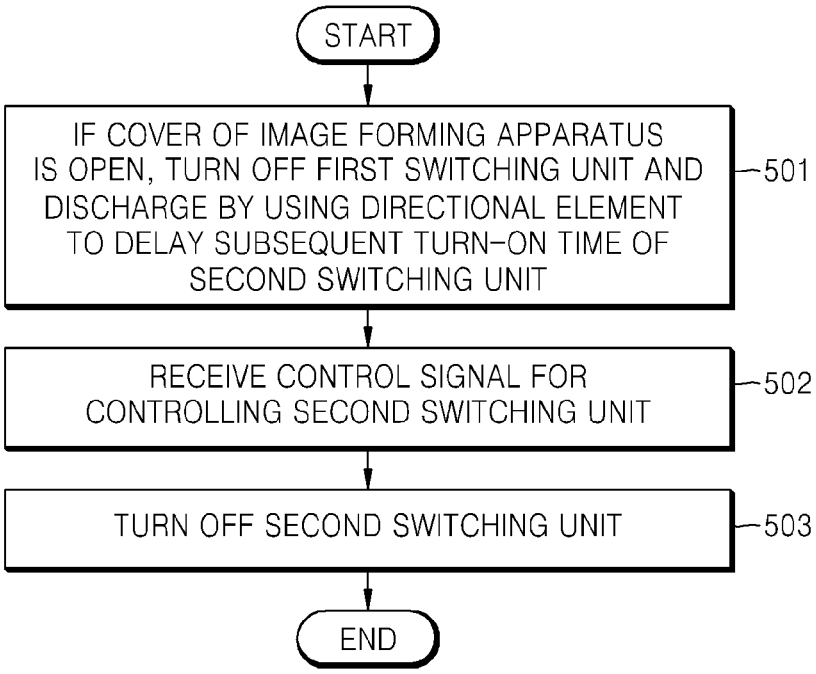
FIG. 5 is a flowchart illustrating a method of supplying power to the image forming apparatus illustrated in FIG. 4 by using the SMPS illustrated in FIG. 1, according to an embodiment of the present general inventive concept.

FIG. 5 is a flowchart illustrating a method of supplying power to the image forming apparatus 200 illustrated in FIG. 4 by using the SMPS 100 illustrated in FIG. 1, according to an embodiment of the present general inventive concept. The method illustrated in FIG. 5 includes time-serial operations performed by the SMPS 100 and the image forming apparatus 200 illustrated in FIGS. 1 through 4. Accordingly, the descriptions provided above in relation to the SMPS 100 and the image forming apparatus 200 illustrated in FIG. 1 through FIG. 4 may also be applied to the method illustrated in FIG. 5.

Referring to FIGS. 2 and 5, in operation 501, if the cover of the image forming apparatus 200 is open, the SMPS 100 turns off the first switching unit 131 to prevent output of the second output voltage. In this case, if the cover of the image forming apparatus 200 is open, the SMPS 100 discharges electric charges stored or charged in the delay unit 133 by using the directional element 134 to subsequently delay the turn-on time of the second switching unit 132 when the first switching unit 131 is closed. The electric charges charged to delay the turn-on time of the second switching unit 132 may be charged in the delay unit 133 when the first switching unit 131 is closed.

However, the discharging of the electric charges may be performed in operation 501, but is not limited thereto, and may be performed after operation 501 before operation 503.

In operation 502, the second switching unit 132 receives a control signal from the main system 210 of the image forming apparatus 200. In this case, the control signal includes a signal representing whether the image forming apparatus 200 is in a power saving mode.

In operation 503, the SMPS 100 turns off the second switching unit 132 according to the received control signal.

Accordingly, the SMPS 100 may prevent generation of an inrush current and thus stable operation of the image forming apparatus 200 may be ensured and standby power of the image forming apparatus 200 may be reduced.

Also, even if the image forming apparatus 200 is in the power saving mode, the SMPS 100 may output a signal representing whether the cover of the image forming apparatus 200 is open or closed, by using a voltage applied from the first switching unit 131 to the second switching unit 132. For example, a voltage of about 0 volt may be applied to the second switching unit 132 if the cover of the image forming apparatus 200 is open, and the second output voltage (e.g., about 24 volt) may be applied to the second switching unit 132 if the cover of the image forming apparatus 200 is closed. Accordingly, the SMPS 100 may output the signal representing whether the cover of the image forming apparatus 200 is open or closed, by using the voltage applied to the second switching unit 132.

As such, even if the image forming apparatus 200 is in the power saving mode, the SMPS 100 outputs a signal representing that the cover of the image forming apparatus 200 is open if the cover of the image forming apparatus 200 is open, and outputs a signal representing the cover of the image forming apparatus 200 is closed if the cover of the image forming apparatus 200 is closed.

Also, if the signal representing that the cover of the image forming apparatus 200 is closed is output from the SMPS 100, the main system 210 of the image forming apparatus 200 switches a mode of the image forming apparatus 200 to a ready mode.

Accordingly, even if the image forming apparatus 200 is in the power saving mode, the image forming apparatus 200 may recognize whether the cover of the image forming apparatus 200 is open or closed and thus the operation efficiency of the image forming apparatus 200 may be ensured.

As described above, according to the present general inventive concept, generation of an inrush current by an SMPS 100 may be prevented, standby power of an image forming apparatus 200 including the SMPS 100 may be reduced in a power saving mode, stable operation of the image forming apparatus 200 according to whether a cover of the image forming apparatus 200 is open or closed may be ensured.

Meanwhile, embodiments of the present general inventive concept can be written as computer programs and can be implemented in general-use digital computers that execute the programs using a computer readable recording medium. Also, the data structure used in the embodiments of the present general inventive concept described above can be recorded on a computer readable recording medium via various means. Examples of the computer readable recording medium include magnetic storage media (e.g., ROM, floppy disks, hard disks, etc.), optical recording media (e.g., CD-ROMs, or DVDs), etc.

While the present general inventive concept has been particularly illustrated and described with reference to exemplary embodiments thereof, it will be understood by one of ordinary skill in the art that various changes in form and details may be made therein without departing from the spirit and scope of the general inventive concept as defined by the following claims. The exemplary embodiments should be considered in a descriptive sense only and not for purposes of limitation. Therefore, the scope of the general inventive concept is defined not by the detailed description of the general inventive concept but by the following claims, and all differences within the scope will be construed as being included in the present general inventive concept.

What is claimed is:

1. A method of supplying power to an image forming apparatus by using a switching mode power supply (SMPS) to output a first output voltage and a second output voltage, the method comprising:

turning off a first switching unit to prevent output of the second output voltage if a cover of the image forming apparatus is open;

receiving from the image forming apparatus a control signal to control a second switching unit of the SMPS, if the image forming apparatus is in a power saving mode; and turning off the second switching unit according to the received control signal.

2. The method of claim 1, wherein the SMPS discharges by using a directional element to delay a turn-on time of the second switching unit, if the cover of the image forming apparatus is open.

3. A non-transitory computer-readable recording medium having recorded thereon a computer program to execute the method of claim 1.

4. A switching mode power supply (SMPS) of an image forming apparatus, the SMPS comprising:

a transformation unit to transform an alternating-current (AC) voltage input to the SMPS into at least one direct-current (DC) voltage by using a transformer;

a first output voltage output unit to output the transformed DC voltage as a first output voltage of the SMPS; and a second output voltage output unit to output the transformed DC voltage as a second output voltage of the SMPS, wherein the second output voltage output unit comprises:

a first switching unit to prevent output of the second output voltage if a cover of the image forming apparatus is open; and a second switching unit to prevent output of the second output voltage if the image forming apparatus is in a power saving mode.

5. The SMPS of claim 4, further comprising a delay unit to delay a turn-on time of the second switching unit.

6. The SMPS of claim 5, further comprising a directional element to discharge electric charges charged by the delay unit if the cover of the image forming apparatus is open.

7. The SMPS of claim 4, wherein the SMPS outputs a signal representing whether the cover of the image forming apparatus is open or closed if the image forming apparatus is in the power saving mode.

8. The SMPS of claim 4, wherein the first switching unit comprises a microswitch or a relay to be turned on or off according to whether the cover of the image forming apparatus is open or closed.

9. The SMPS of claim 4, wherein the second switching unit outputs a signal representing whether the cover of the image forming apparatus is open or closed.

10. The SMPS of claim 4, wherein, if the cover of the image forming apparatus is open and then is closed within a first period of time, the second switching unit is turned on after a second period of time after the cover of the image forming apparatus is closed, by using a control signal output from the image forming apparatus, and wherein the first period of time is less than a period of time to completely discharge electric charges charged by a delay unit to delay a turn-on time of the second switching unit.

11. The SMPS of claim 4, wherein the second switching unit comprises:

a transistor to be turned on or off by using a control signal output from the image forming apparatus; and a metal-oxide-semiconductor field-effect transistor (MOSFET) to be turned on or off according to an on or off operation of the transistor.

12. The SMPS of claim 11, wherein a signal representing whether the cover of the image forming apparatus is open or closed is output from a source voltage terminal of the MOSFET.

13. The SMPS of claim 11, wherein, if the cover of the image forming apparatus is open and then is closed within a first period of time, the MOSFET is turned on after a second period of time after the cover of the image forming apparatus is closed, and wherein the first period of time is less than a period of time to completely discharge electric charges charged by a delay unit to delay a turn-on time of the second switching unit.

14. The SMPS of claim 13, wherein a sum of the first period of time and the second period of time is greater than the period of time to completely discharge the electric charges charged by the delay unit.

15. An image forming apparatus comprising a switching mode power supply (SMPS) to output a first output voltage and a second output voltage, the image forming apparatus comprising:

the SMPS to turn off a first switching unit to prevent output of the second output voltage if a cover of the image forming apparatus is open, to receive from the image forming apparatus a control signal to control a second switching unit of the SMPS, and to turn off the second switching unit according to the received control signal;

a main system to be operable by the first output voltage if the cover of the image forming apparatus is open, and to output the control signal to control the second switching unit; and an image forming unit to be operable by the second output voltage, and to form an image of print data.

16. The image forming apparatus of claim 15, wherein the SMPS discharges by using a directional element and a delay unit to delay a turn-on time of the second switching unit, if the cover of the image forming apparatus is open.

17. The image forming apparatus of claim 15, wherein the SMPS outputs a signal representing whether the cover of the image forming apparatus is open or closed, if the image forming apparatus is in a power saving mode.

18. The image forming apparatus of claim 15, wherein the main system switches a mode of the image forming apparatus to a ready mode if the cover of the image forming apparatus is closed, by referring to a signal output from the SMPS.

19. The image forming apparatus of claim 15, wherein the main system outputs the control signal to turn on the second switching unit of the SMPS after a second period of time after the cover of the image forming apparatus is closed, if the cover of the image forming apparatus is open and then is closed within a first period of time, by referring to a signal output from the SMPS.

20. The image forming apparatus of claim 19, wherein a sum of the first period of time and the second period of time is greater than a period of time to completely discharge electric charges charged to delay a turn-on time of the second switching unit.

21. A switching mode power supply (SMPS) apparatus of an image forming apparatus comprising:

a transformation unit to transform an AC voltage into at least one DC voltage input to the SMPS; and a voltage output unit to output the transformed DC voltage as an output voltage of the SMPS, the voltage output unit comprising:

a first switching unit to turn off and send a notification signal to the image forming apparatus when a cover of the image forming apparatus is opened;

a second switching unit to turn off upon receiving a control signal from the image forming apparatus after the turning off of the first switching unit; and a delay unit connected between the first switching unit and the second switching unit to discharge electric charges after the turning off of the first switching unit to prevent abrupt turn on of the second switching unit.

22. The SMPS apparatus of claim 21, wherein the first switching unit receives an output voltage from the transformation unit.

23. The SMPS apparatus of claim 21, wherein the second switching unit is connected to the first switching unit and is turned on after the first switching unit is turned on.

24. The SMPS apparatus of claim 21, further comprising:

a first terminal to output the transformed DC voltage to the image forming apparatus; and a second terminal to receive a signal from the image forming apparatus to indicate that the image forming apparatus is in a power saving mode after the first switching unit is turned off.

25. The SMPS apparatus of claim 21, wherein the second switching unit comprises:

a first transistor turned on or off by the control signal output from the image forming apparatus.

26. The SMPS apparatus of claim 25, wherein the second switching unit further comprises:

a second transistor to be turned on or off according to the on or off operation of the first transistor.

27. The SMPS apparatus of claim 25, wherein the second switching unit further comprises:

a second transistor to be turned on or off according to a voltage applied to the second transistor by the first switching unit.

28. The SMPS apparatus of claim 25, wherein the second switching unit further comprises:

a second transistor to be turned off when a difference between a source voltage and a gate voltage of the second transistor is less than a predetermined threshold voltage.

29. The SMPS apparatus of claim 25, wherein the second switching unit further comprises:

a second transistor, wherein the image forming apparatus uses a second control signal to turn off the first transistor to prevent the second transistor from being turned on when the first switching unit is turned on.

30. A method of operating a switching mode power supply (SMPS) of an image forming apparatus, the method comprising:

turning off a first switching unit of the power supply after detecting a cover of the image forming apparatus being opened;

receiving a signal from the image forming apparatus to operate the SMPS in a power saving mode after turning off the first switching unit; and discharging electric charges through a delay unit of the SMPS to prevent abrupt turn on of a second switching unit of the SMPS.

31. The method of claim 30, further comprising:

turning on the first switching unit after detecting a closing of the cover; and charging the delay unit to delay a turn-on time of the second switching unit after the turning on of the first switching unit.

32. The method of claim 30, further comprising:

turning on the first switching unit before the discharging of the delay unit is complete;

notifying the image forming apparatus that the delay unit is not totally discharged; and receiving a control signal from the image forming apparatus to prevent turn on of the second switching unit before total discharge of the delay unit.

33. The method of claim 32, wherein the control signal turns off a first transistor of the second switching unit to prevent the turn on of a second transistor of the second switching unit.

34. The method of claim 32, wherein the delay unit of the SMPS is discharged for a first period of time and the image forming apparatus delays the control signal to control a transistor of the second switching unit by a second period of time greater than the first period of time.

35. A method of operating a switching mode power supply (SMPS) of an image forming apparatus, the method comprising:

turning off a first switching unit upon opening of a cover of an image forming apparatus;

receiving a control signal from the image forming apparatus that the image forming apparatus is in a power save mode after the first switching unit is turned off;

turning on the first switching unit upon closing the cover to put the image forming apparatus in a ready mode; and delaying a turn-on time of a second switching unit in the ready mode to prevent the SMPS from being abruptly turned on.

36. A method of operating a switching mode power supply (SMPS) of an image forming apparatus, the method comprising:

turning off a first switching unit in the SMPS to prevent DC voltage being applied to a second switching unit;

discharging electric charges in a delay unit of the SMPS upon turning off the first switching unit; and turning off the second switching unit after discharging the electric charges charged in the delay unit to reduce power consumption of the SMPS.

37. The method of claim 36, wherein the second switching unit is turned off by receiving a control signal from the image forming apparatus when the cover of the image forming apparatus is closed.

* * * * *